US009607800B1

(12) United States Patent
Loeffler

(10) Patent No.: US 9,607,800 B1
(45) Date of Patent: Mar. 28, 2017

(54) HIGH BRIGHTNESS ELECTRON IMPACT ION SOURCE

(71) Applicant: Nonsequitur Technologies, Inc., Bend, OR (US)

(72) Inventor: Peter E. Loeffler, Bend, OR (US)

(73) Assignee: Nonsequitur Technologies, Inc., Bend, OR (US)

( * ) Notice: Subject to any disclaimer, the term of this patent is extended or adjusted under 35 U.S.C. 154(b) by 0 days.

(21) Appl. No.: 15/071,950

(22) Filed: Mar. 16, 2016

(51) Int. Cl.
*H01J 27/00* (2006.01)
*H01J 27/20* (2006.01)
*H01J 27/02* (2006.01)

(52) U.S. Cl.
CPC ..... *H01J 27/205* (2013.01); *H01J 27/022* (2013.01)

(58) Field of Classification Search
CPC ..... H01J 27/205; H01J 27/022
USPC ..... 250/427
See application file for complete search history.

(56) References Cited

U.S. PATENT DOCUMENTS

2007/0176115 A1* 8/2007 Horsky ..... H01J 27/205 250/427
2010/0320395 A1* 12/2010 Hahto ..... H01J 27/205 250/426

OTHER PUBLICATIONS

Liu, N. et al.; "Brightness Measurement of an Electron Impact Gas Ion Source for Proton Beam Writing Applications"; Review of Scientific Instruments; Presented Aug. 15, 2015; received Aug. 22, 2015; accepted Sep. 10, 2015; published Oct. 5, 2015, pp. 87-89, 3 pages.

* cited by examiner

*Primary Examiner* — Michael Maskell
(74) *Attorney, Agent, or Firm* — Kilpatrick Townsend & Stockton LLP; Kenneth R. Allen

(57) ABSTRACT

An electron impact ion beam source is provided with a pressure chamber to confine a specific high pressure area within excited gas to a small enough volume that the source can be operated at relatively high pressure and still achieve substantial brightness of the extracted ion beam. In particular, the area is configured such that the overall linear dimension along the beam path is less than the mean free path of the ions and the electrons within the chamber. If pressure is increased, the linear dimension must be correspondingly decreased to maximized brightness. By keeping linear dimensions sufficiently small, both incident electrons and extracted ions are enabled to transit the source region without significant energy loss. The new source design allows operation at pressures at least an order of magnitude higher than other known ion sources and thus produces an order of magnitude higher brightness.

5 Claims, 2 Drawing Sheets

HIGH BRIGHTNESS ELECTRON IMPACT ION SOURCE

CROSS-REFERENCES TO RELATED APPLICATIONS

Not Applicable

STATEMENT AS TO RIGHTS TO INVENTIONS MADE UNDER FEDERALLY SPONSORED RESEARCH AND DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

This invention relates to ion source devices and in particular to a high brightness electron impact gas phase ion source device for use in connection with a focusing column.

In order to produce a small intense focused ion beam spot, it is preferred to start with the brightest possible ion source. One way to increase the brightness in a gas phase ion source is to increase the plasma density in the source. In an electron impact source, increasing the gas pressure will increase the plasma density. At some gas pressure, depending upon the geometry of the source, the mean free path of both the electrons used to ionize the gas and the ions being extracted will become short enough that the brightness of the source decreases due to collisions in the gas. This discovery is exploited in a novel manner in the invention herein disclosed.

Representative prior art includes existing electron impact source devices manufactured by the assignee of the present invention. While the prior art beam source device operates at a relatively high pressure compared with other known source devices, the closest prior art is a relatively open source and thus has a large area in which the gas pressure is comparatively high. As a consequence of the resultant limit on the mean free path of the ions, there is a practical upper limit on beam intensity.

BRIEF SUMMARY OF THE INVENTION

According to the invention, an electron impact ion beam source is provided with a pressure chamber to confine a specific high pressure area within excited gas to a small enough volume that the source can be operated at relatively high pressure and still achieve substantial brightness of the extracted ion beam. In particular, the area is configured such that the overall linear dimension along the beam path is less than the mean free path of the ions and the electrons within the chamber. If pressure is increased, the linear dimension must be correspondingly decreased to maximized brightness. By keeping linear dimensions sufficiently small, both incident electrons and extracted ions are enabled to transit the source region without significant energy loss. The new source design allows operation at optimal pressures at least an order of magnitude higher than other known ion sources and thus produces an order of magnitude higher brightness.

The invention will be better understood by reference to the following detailed description in connection with the accompanying drawings.

DETAILED DESCRIPTION OF THE INVENTION

This invention description assumes familiarity with ion beam device structures of the prior art in which an electron beam is directed into a chamber containing a material to be ionized and wherein the extract ions are focused by a focusing column (not shown) on a target (not shown). In this disclosure, the target material to be ionized is preferably a gas such as argon or hydrogen, or any suitable gas that meets the criteria for the particular application. These particular elements have advantages in certain applications in that they leave no material residue on the target. At least the following materials are suitable as ion sources: hydrogen, deuterium, tritium, helium, nitrogen, oxygen, neon, argon, xenon, sulfur hexafluoride, carbon dioxide, and the halogen gases, such as chlorine and fluorine. The invention is not limited by the ion source material.

Figure 1C:
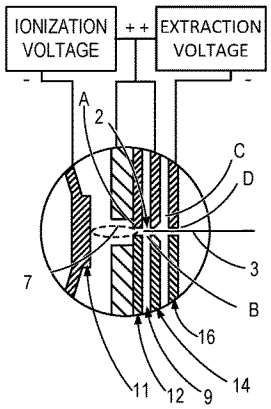
FIG. 1C is a schematic cross-section of FIG. 1A in a tight expanded view showing the gas chamber in an electron impact ion beam source according to the invention.
Figure 1B:
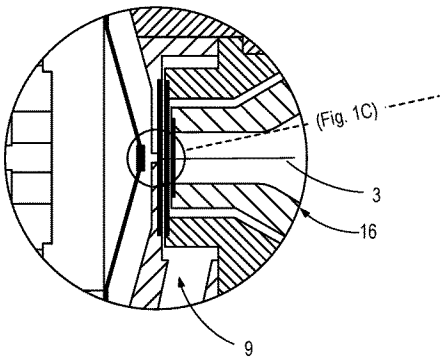
FIG. 1B is a schematic cross-section of FIG. 1A in a medium expanded view showing the region of the gas chamber in an electron impact ion beam source according to the invention.
Figure 1A:
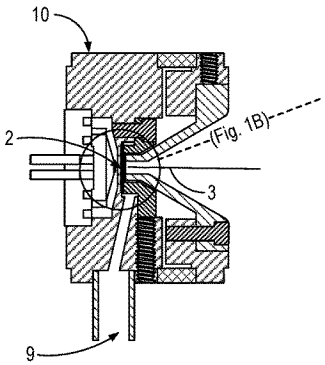
FIG. 1A is a schematic cross-section of a first embodiment of an electron impact ion beam source with an internal high pressure gas chamber according to the invention
Figure 2C:
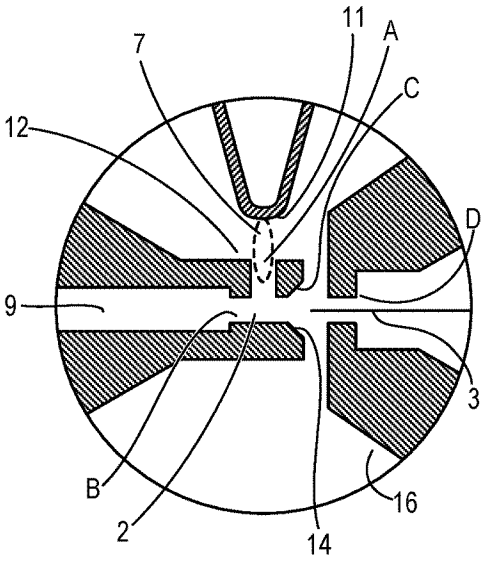
FIG. 2C is a schematic cross-section FIG. 2A in a tight expanded view showing the gas chamber in an electron impact ion beam source according to the invention.
Figure 2B:
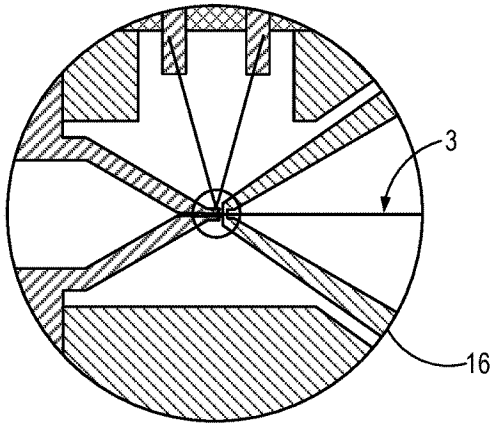
FIG. 2B is a schematic cross-section of FIG. 2A in a medium expanded view showing the region of the gas chamber in an electron impact ion beam source according to the invention.
Figure 2A:
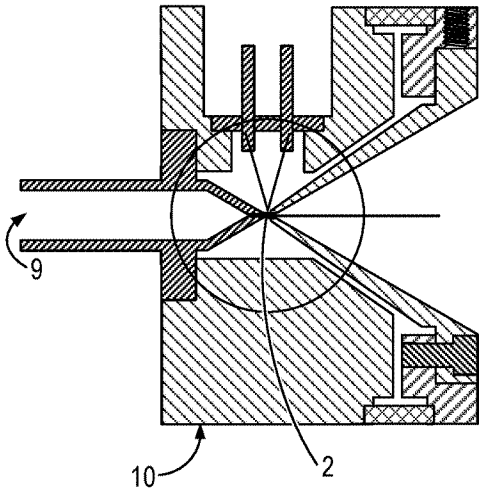
FIG. 2A is a schematic cross-section of a second embodiment of an electron impact ion beam source with an internal high pressure gas chamber according to the invention

Referring to FIGS. 1A, 1B and 1C, wherein gas inlet is lateral to the ion beam 3, and to FIGS. 2A, 2B and 2C, wherein gas inlet is along the axis of the ion beam 3, an ion beam source device 10 is shown in various exploded views as it is within an enclosed vacuum chamber (not shown) adjacent a focusing column (not shown). It has an electron emitter 11, an anode 12, an outlet electrode 14, and an extraction electrode 16 that are adjacent a gas-pressurized conductive (constructed of metal) ionization chamber 2, according to the invention. The ionization chamber 2 of the invention receives gas to be ionized that is admitted via a gas inlet 9 through an Aperture B. According to the invention, the core of the ionization chamber 2 is small, having a linear dimension along a path length for of an ion beam 3 where the chamber length is less than the mean free path of ions at the nominal gas pressure within the chamber 2. Energized free electrons 7 are electrostatically introduced from a cloud that is preferably concentrated into a focused beam and that is admitted into the chamber 2 to ionize the targeted gas to be ionized that is received through the gas inlet 9. When the overall linear dimension along the beam path is less than the mean free path of the ions (and the electrons) within the chamber 2, the intensity or brightness of the resultant ions can be maximized as pressure is increased. The linear dimension is thus on the order of 0.1 mm (+/−0.025 mm) for a pressure at about $10^{-1}$ Torr. However, ranges as high as 0.5 mm and as small as 0.0001 mm (0.1 micron) may be considered. There are typically four apertures A, B, C, D in the ionization chamber 2 for introduction of gas and electrons and for extraction of ions and excess gas. Aperture B is the primary gas inlet and is preferably as large as possible for inflow of gas, whereas apertures A and C are for gas outflow from the source. The lower limit on chamber size is the practical limit on current capacity within the ionization chamber 2 and the size of apertures A, B, C, D in the chamber 2 and other mechanical factors. For example, the limit on the size of a useable ionization chamber 2 may be based upon the ratio of the chamber inner surface area to the cross-sectional area of apertures A and C in the chamber 2. The size of aperture B is preferably large but is limited by the consideration that the internal length of the chamber cannot be too long. For a spherical chamber 2 of 1 micron (0.001 mm) nominal diameter (length), having an inner surface area of 0.25×4×Pi=Pi square microns, and having three 0.5 micron apertures (=0.75 square microns), the ratio is about 4.2:1.0. This is a ratio sufficiently large to maintain high pressure in the chamber 2 without unacceptable gas leakage and still be able to generate an ion beam of substantial brightness. However, in a specific embodiment, a pressure chamber 2 may be as is shown, namely a chamber having a short distance along the ion path with extended lateral dimensions.

Accordingly, as shown in FIG. 1C the source 10 includes an intentionally small and short high-pressure chamber 2 with a gas inlet 9 for an ionizable gas, a small beam extraction aperture D and one or more small electron inlet apertures A such as formed in a perforated electron anode and that admits electrons 7 from an electron emitter 11 to ionize the highly pressurized gas inside the ionization chamber 2. Within constraints the desire to maintain pressure, the electron inlet aperture A should be large as possible to admit electrons. The ions may be introduced into the chamber 2 either off axis or on-axis to the beam extraction aperture D adjacent the extraction electrode (cathode) 16. The volume surrounding the source 10 (namely a vacuum chamber) may be continuously pumped to maintain a good vacuum and thus long mean free path outside of the chamber 2. Gas is supplied under high pressure to the chamber 2 within the source 10 by the gas inlet 9. Emitted from the chamber 2 is the ion beam 3 through aperture D.

Applications of such a beam source include uses in a Focused Ion Beam device with performance comparable to a liquid metal ion beam but without the attendant sample contamination issues. Other applications would be in ion microscopy and fusion devices.

The invention has been explained with reference to specific embodiments. Other embodiments will be evident to those of skill in the art. It is therefore not intended that this invention be limited except as indicated by the appended claims.

What is claimed is:

1. An ion beam source device comprising:

an electron source;

a vacuum chamber, the vacuum chamber containing a pressure chamber, the pressure chamber having:

a first aperture for inlet of pressurized gas to be ionized;

a second aperture for input of electrons of the electron source;

a third aperture for emission of ions of the pressurized gas along a path having a linear dimension; and an ion extracting sink in form of an electrode, said ion extracting sink being disposed adjacent the third aperture;

wherein the pressure chamber is configured to have a length along the linear dimension of the path that is less than the mean free path of the gas along the linear dimension at the established pressure within the pressure chamber;

so that brightness of the ions may be enhanced with minimal decrease due to gas pressure in the pressure chamber.

2. The device according to claim 1 wherein the first aperture is in line with the third aperture.

3. The device of claim 1 wherein the first aperture is not in line with the third aperture.

4. The device according to claim 2 wherein the distance along the linear dimension is between 0.001 mm and 1.25 mm.

5. The device according to claim 3 wherein the distance along the linear dimension is between 0.001 mm and 1.25 mm.

* * * * *